US005634778A

United States Patent [19]

Liegel et al.

[11] Patent Number: 5,634,778

[45] Date of Patent: Jun. 3, 1997

[54] REMOTE CONTROL PUMP

[75] Inventors: Reinald D. Liegel; James G. Ballard, both of Waukesha, Wis.

[73] Assignee: Hein-Werner Corporation, Waukesha, Wis.

[21] Appl. No.: 346,678

[22] Filed: Nov. 30, 1994

[51] Int. Cl.[6] ..... F04B 23/00

[52] U.S. Cl. ..... 417/313; 251/129.04; 417/234

[58] Field of Search ..... 417/313, 63, 234; 251/129.04, 129.15; 137/351, 565

[56] References Cited

U.S. PATENT DOCUMENTS 4,852,802 8/1989 Iggulden et al. ..... 137/78.3

5,263,824 11/1993 Waldbeser et al. ..... 417/63

5,336,054 8/1994 Seah et al. ..... 417/63

*Primary Examiner*—Timothy Thorpe

*Assistant Examiner*—Peter G. Korytnyk

*Attorney, Agent, or Firm*—James A. Wilke

[57] ABSTRACT

A wireless remote control apparatus mounted on a fluid pump for controlling the pump and release functions of such fluid pump. The wireless remote control apparatus includes valves in fluid communication with a fluid supply, actuators for controlling the pump and release valves of the pump, a signal transmitting and signal receiving device operatively associated with the fluid pump. The wireless remote control apparatus can operate on a frequency selected from radio, ultraviolet and infra red frequencies and is further provided with a manual operating mechanism.

4 Claims, 6 Drawing Sheets

REMOTE CONTROL PUMP

FIELD OF THE INVENTION

The present invention relates to fluid pumps and particularly to a wireless remote controlled fluid pump.

BACKGROUND OF THE INVENTION

Fluid pumps, particularly hydraulic oil pumps, for actuating vehicle repair equipment are well known. Fluid pumps are used to raise and lower vehicle repair and alignment racks and to provide power to tension members used with force applying structures such as shown in U.S. Pat. Nos. 4,313,335 and 4,794,783. Such fluid pumps are typically powered by compressed air which drives an air motor connected to a pumping mechanism. An operator of the fluid pump controls the pump by a series of valves which are connected to the air motor and pump and actuated manually by levers. Some applications of a fluid pump can also be powered by an electric motor connected to the pumping mechanism. In either case, the air over hydraulic pump or the electric over hydraulic pump, the valve controls are on the pump housing and are actuated by foot levers. In some cases the valve controls are operated by extended actuators attached to the pump house by a length of hose or wire. An example of such control system is shown in the sales brochure of Enerpac, a Unit of Applied Power, Inc. (a copy of which is in the attached appendix).

In most cases the operator of the pump must be close to the work area in which the tool powered by the hydraulic fluid being pumped, is located. Such placement can expose the operator to dangers of equipment malfunctions, part breakage and part projectiles. Although manufacturers of such equipment provide instructions and warnings, events of property damage and personal injury do occur. The present invention removes the operator from such locations by allowing the operator to operate a fluid pump at a distance remote from the fluid pump and the immediate work area.

SUMMARY OF THE INVENTION

The present invention provides a wireless remote control apparatus mounted on a fluid pump for controlling the pump and release functions of such fluid pump. The wireless remote control apparatus includes at least one, two position, three way solenoid valve in fluid communication with a fluid supply and actuators for controlling the pump and release valves of the fluid pump. The solenoid is energized by an electrical power source and is operatively connected to a signal receiving device also connected to the electrical power source. The signal receiving device is operatively associated with a signal transmitting device which signal transmitting device is remotely located from the fluid point. A frequency for the transmitted and received control signal must be the same however the frequency can be different for each fluid pump associated with the vehicle repair system, i.e., one fluid pump can be used to raise and lower the vehicle repair rack and a different fluid pump may be used to operate each of the force applying structures. The use of one transmitter capable of transmitting different control signals is well known such as in a hobbyist's remote control vehicle.

DETAILED DESCRIPTION OF THE PREFERRED EMBODIMENT

Figure 1:
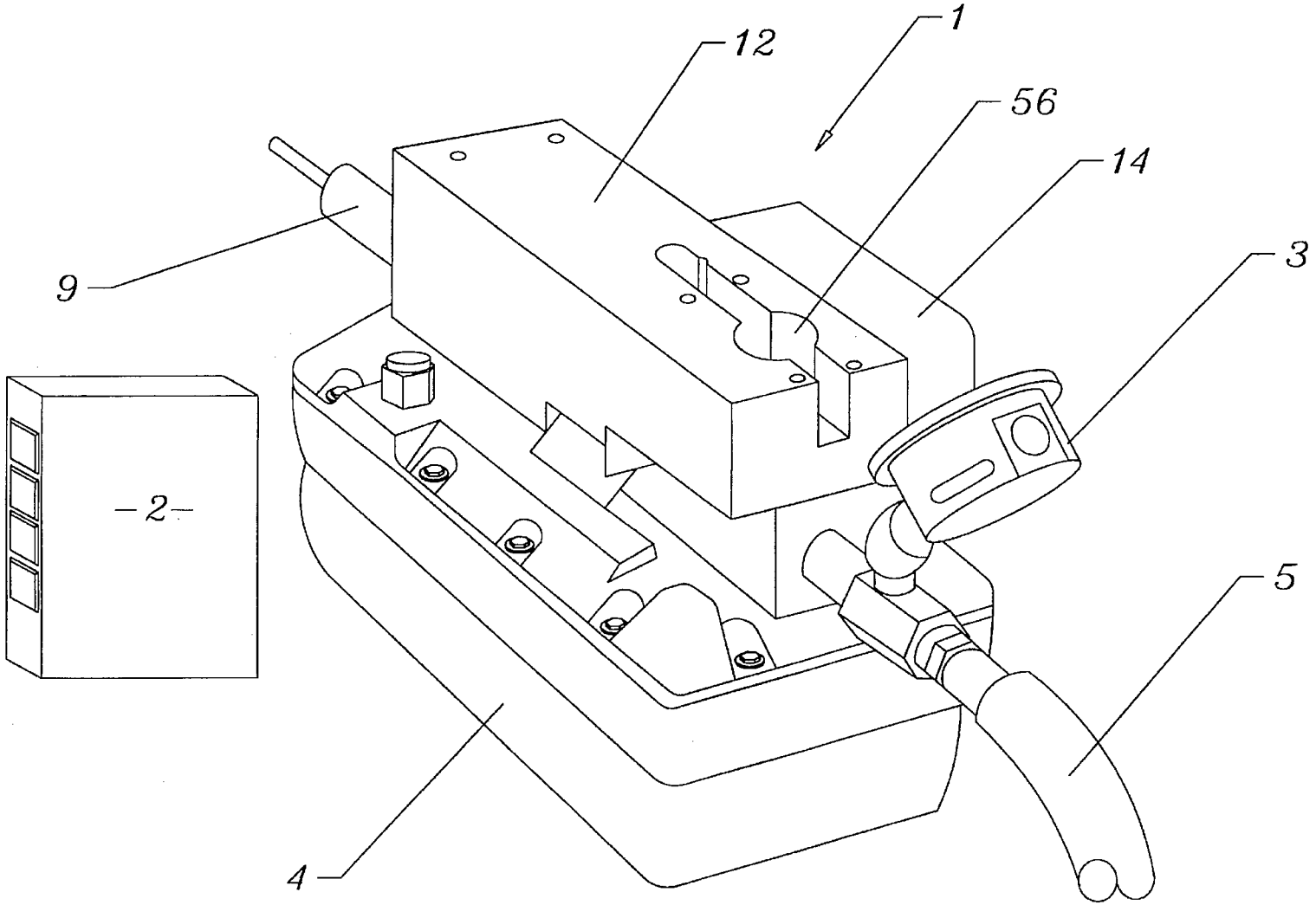
FIG. 1 is a perspective view of the wireless, remote control pump embodying the present invention.
Figure 2:
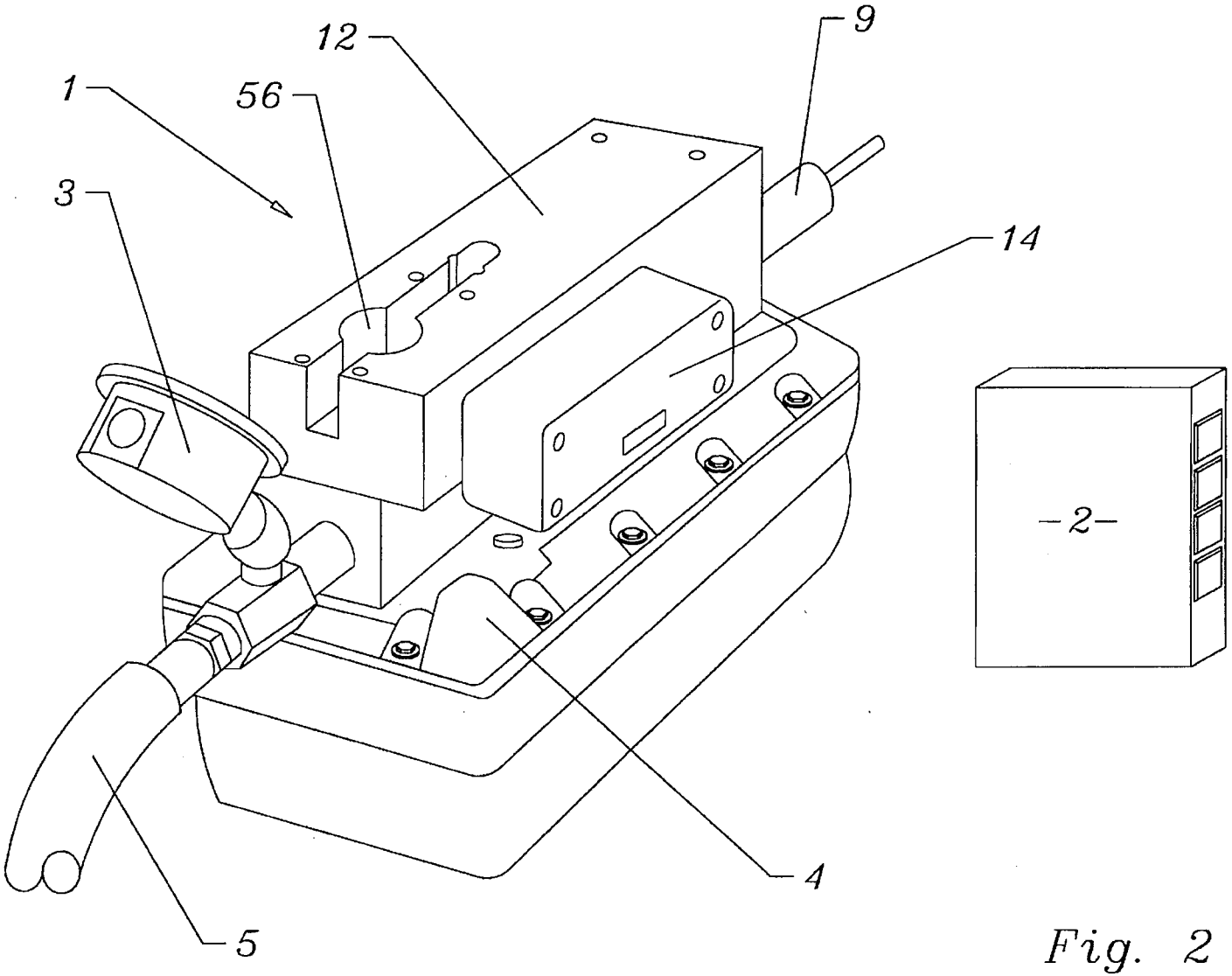
FIG. 2 is a perspective view of the present invention as shown in FIG. 1 rotated 90°.

A wireless remote control apparatus 1 mounted on a fluid pump 4, as shown in FIGS. 1 and 2 generally includes a valve block 12 mounted on the fluid pump 4. The wireless remote control apparatus 1 also includes a control box 14 which includes the electric power source, which in the preferred embodiment is a battery pack 20, and the relays and signal receiver (described below). Operatively associated with the signal receiver 16 and a part of the present invention is the signal transmitter 2. The illustrated embodiment of the present invention discloses a hydraulic oil pump that is operated with compressed air, which is supplied to the pump through the supply hose 9. The hydraulic oil exits the pump 4 through the hose 5 with the hydraulic oil pressure registered on the pressure gauge 3.

The fluid pump typically operates by an operator depressing a pump button 6. The pump button activates a motor (not shown) either air powered or electric powered, which drives the pump mechanism (not shown) and pumps the hydraulic fluid from a reservoir to a hydraulic cylinder (not shown). Pressure in the fluid pump is released by the operator depressing a release button 10 on the fluid pump, which allows the hydraulic fluid to return, from the hydraulic cylinder, to the pump reservoir. A typical fluid pump, presently used in the vehicle repair business, utilizes a pivoting rocker lever that an operator may manipulate with either a hand or foot. The lever engages the pump button 6 and the release button 10 as determined by the operator to operate the pump.

The vehicle repair business also utilizes an electric over hydraulic pump which operates in a similar manner as the above described air over hydraulic pump. The principal difference is that the electric over hydraulic pump uses an electric motor to operate the pump and is controlled by electrical components rather than a pivoting rocker lever. The present invention may be embodied in an apparatus to control both types of the above described fluid pumps in the vehicle repair business.

Figure 3:
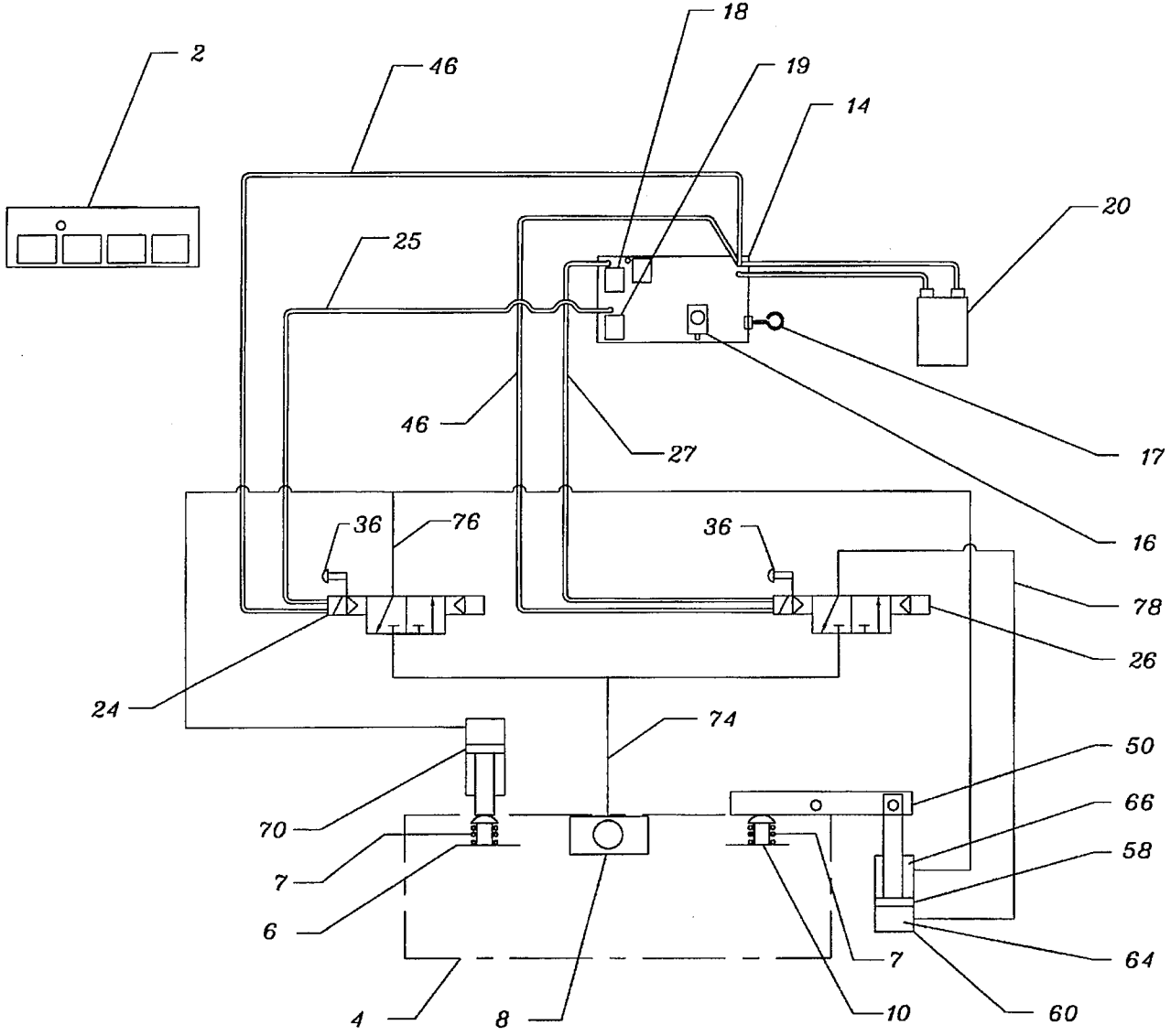
FIG. 3 is a schematic illustration of the present invention.

FIG. 3 is a schematic illustration of the present invention in relation to an air/hydraulic pump 4. The pump 4 is provided with a pump button 6 having a return spring 7, an air supply port 8 and a release button 10 which also has a return spring 7.

Figure 4:
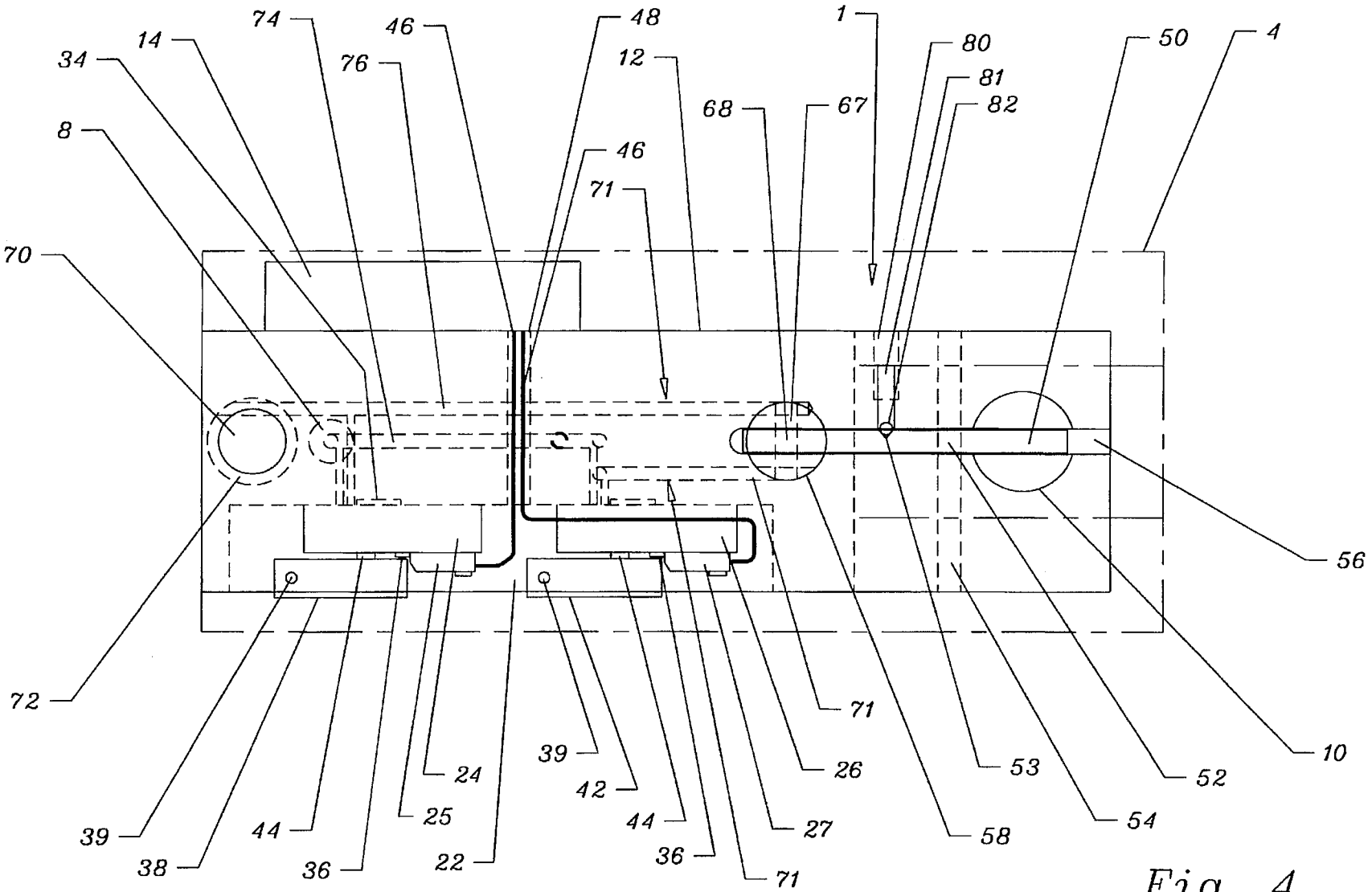
FIG. 4 is a top view of the valve block 12 illustrating the principal elements of the present invention and the fluid conduit network 71.
Figure 5:
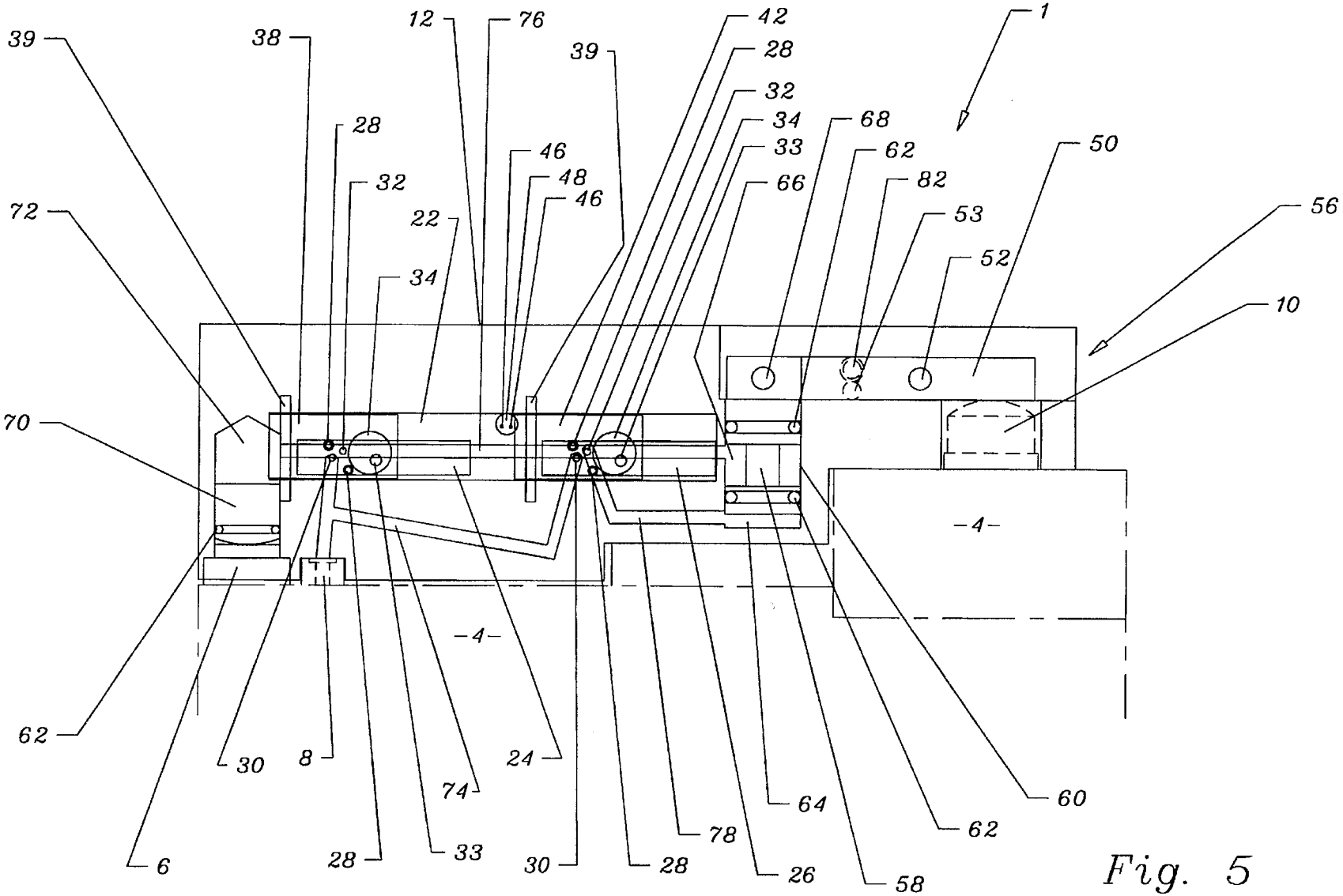
FIG. 5 is a side view of the present invention showing the piston position and lever position in the pump mode.
Figure 6:
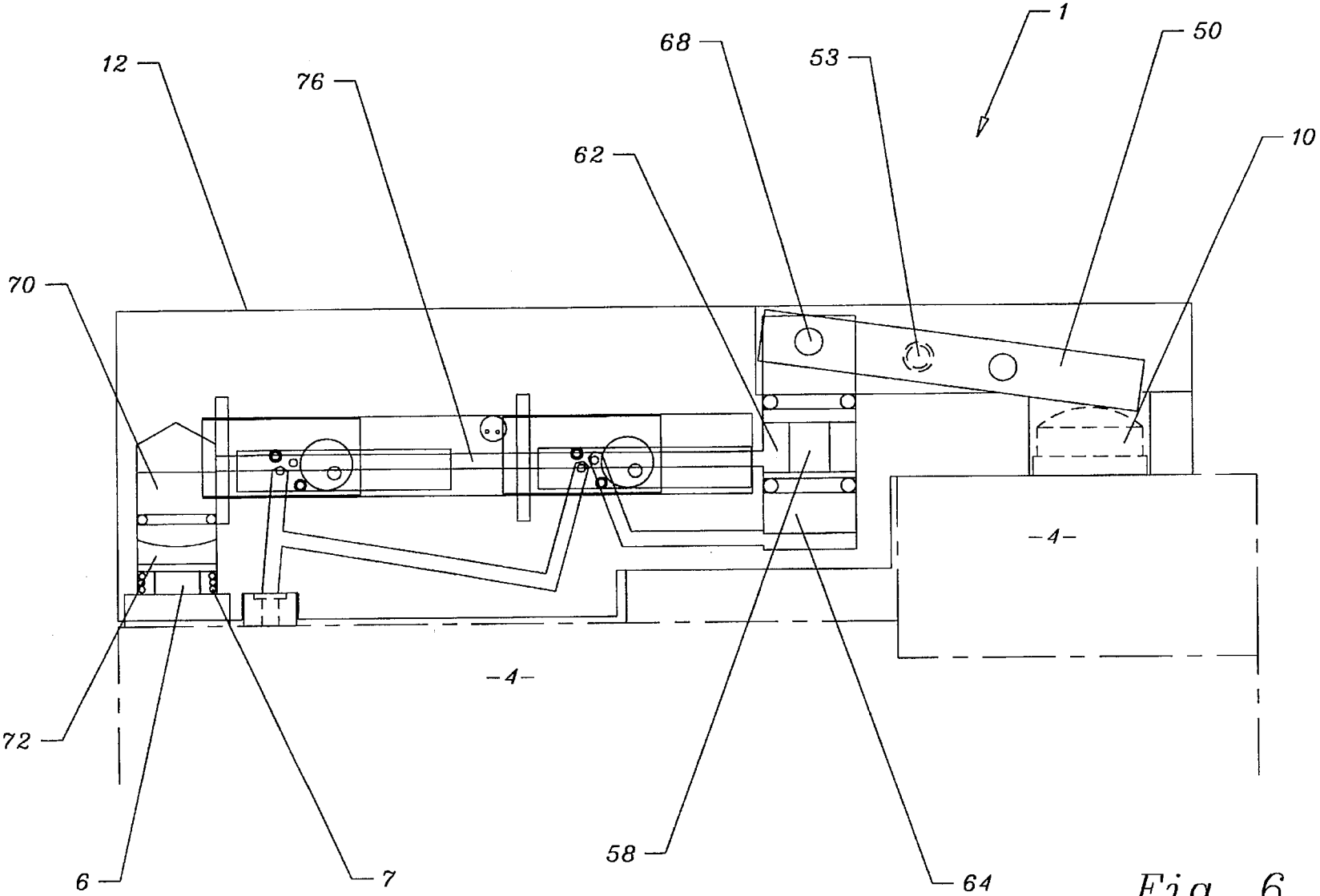
FIG. 6 is a side view of the present invention illustrating the pistons position and the lever position in the release mode.

As shown in FIG. 4 the valve block 12 includes a fluid conduit network 71 in fluid communication with a lever piston cavity 60, a pump button piston cavity 72, and a valve channel 22. The fluid conduit network 71 comprises the air supply conduit 74, the working air conduit 76 and the up air conduit 78. A pump valve 24 and release valve 26 are mounted in the valve channel 22 and in fluid communication with the fluid conduit network 71. The pump valve 24 and release valve 26 each have an electrical connector, 25 and 27 respectively. The electrical connectors 25 and 27 are connected to the control box 14 by wires 46. Electrical power is supplied to the pump valve 24 and release valve 26, through the wires 46, from the battery pack 20 as selectively controlled by a first relay 18 connected to the release valve 26 and a second relay 19 connected to the pump valve 24 in response to a signal sent by a remote signal transmitter 2 to a signal receiver 16 mounted in the control box 14. The battery pack 20 provides the electrical energy to the first relay 18, the second relay 19, the pump valve 24, the release valve 26 and the receiver 16. The utilization of a battery pack 20 for the power source for the various components, eliminates a power cord from the immediate work area in which the vehicle repair process is taking place.

A pump button piston 70 moves up and down in the pump button piston cavity 72 in response to fluid moving into the cavity 72 through the working air conduit 76 from the pump valve 24. The pump button piston 70 pushes against the pump button 6 to operate the pump 4. Concurrently, fluid passes through the working air conduit 76 into a down air chamber 66 contained in a lever piston cavity 60. The lever piston cavity contains a lever piston 58 which is shaped to form two chambers, an up air chamber 64 and a down air chamber 66. The lever piston 58 is operatively connected to a lever 50 with a lever/piston connector 68. The lever is pivotly connected to the valve block 12, in a lever slot 56 by a lever pivot 52 with one end of the lever 50 in operative connection with the release button 10 of the pump 4. The release button 10 is free to open when fluid enters the down air chamber 66 through the working air conduit 76. The fluid pushes the lever piston 58 down thereby pulling the lever 50 down about the lever pivot 52. When the operator desires to release the hydraulic pump pressure, the operator operates the release valve 26 thereby opening the working air conduit 76 to the atmosphere and conveying fluid from the air supply conduit 74 through the release valve 26 to the up air conduit 78 into the up air chamber 64 of the lever piston cavity 60. The fluid in the up air chamber 64 pushes the lever piston 58 up and pushes the lever 50 down about the lever pivot 52 against the release button 10 thereby releasing the hydraulic pressure in the pump 4. Fluid seals are maintained in the up air chamber 64, the down air chamber 66 and the pump button piston cavity 72 by suitable annular seals 62. By selectively operating the pump button 6 and the release button 10, the operator can pump and release the hydraulic pressure of the pump 4. The lever can be maintained in a position with a lever detente 53 engaging a ball 82 held in a ballholder 81 located in the valve block 12 and accessed through a ball access hole 80.

The operator sends a signal, to pump or release, with a signal transmitter 2 to a receiver 16 in the control box 14. The signal may be selected from an electromagnetic frequency group consisting of radio, ultraviolet and infra red frequencies and can also be operated on an audio signal. The preferred signal is in the radio range and is received by an antenna 17 located in the control box 14. In the event that battery power is lost or diminished to the point of not operating the electronics in the control box 14, the remote control apparatus is provided with a manual pump button 38 and a manual release button 42 operatively associated, respectively, with the pump valve 24 and the release valve 26.

The remote control pump of the present invention may also be provided with a suitable housing and handle to improve the aesthetics and portability of the pump.

Thus, it should be apparent that there has been provided in accordance with the present invention a wireless remote control pump for use with vehicle repair equipment that satisfies the objectives and advantages set forth above. Although the invention has been described in conjunction with the specific embodiment thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. A remote control apparatus mounted on a fluid pump controlling the pump with the pump having a pump button and a release button, said remote control apparatus comprising:

a valve block having a plurality of openings, including a pump button piston cavity, a lever piston cavity and a valve channel, a pump button piston slidingly contained in the pump button piston cavity, a lever piston slidingly contained in the lever piston cavity and defining an up-air chamber and a down-air chamber, a fluid conduit network comprising a fluid supply conduit in communication with a fluid supply port and the valve channel, a working air conduit in fluid communication with the valve channel, the pump button cavity and the down-air chamber and a fluid up air conduit in fluid communication with the valve channel and the up-air chamber, an electric control board electrically connected to a power source, a first relay, a second relay and a signal receiver, a signal transmitter operatively associated with the signal receiver, a pump valve in fluid communication with the fluid supply port, the lever piston cavity and the pump button piston cavity and in electric connection with the electric control board, and a release valve in fluid communication with the fluid supply port and the lever piston cavity and in electric connection with the electric control board.

2. The remote control apparatus of claim 1 wherein the signal receiver and signal transmitter operate on a signal selected from an electromagnetic frequency group consisting of radio, ultraviolet and infra red frequencies.

3. The remote control apparatus of claim 1 wherein the signal receiver and signal transmitter operate on an audio signal.

4. The remote control apparatus of claim 1 including a first manual button mounted in the valve block and in operatively association with the pump valve and a second manual button mounted in the valve block and operatively associated with the release valve.

* * * * *